US006527053B2

(12) United States Patent
Friisk

(10) Patent No.: US 6,527,053 B2
(45) Date of Patent: Mar. 4, 2003

(54) ARRANGEMENT RELATED TO RISER PIPELINES

(75) Inventor: Harald Arnt Friisk, Oslo (NO)

(73) Assignee: Norsk Hydro ASA, Olso (NO)

( * ) Notice: Subject to any disclaimer, the term of this patent is extended or adjusted under 35 U.S.C. 154(b) by 0 days.

(21) Appl. No.: 09/826,829

(22) Filed: Apr. 6, 2001

(65) Prior Publication Data

US 2002/0144819 A1 Oct. 10, 2002

(51) Int. Cl.[7] ..... E21B 29/12; E21B 17/01

(52) U.S. Cl. ..... 166/346; 166/355; 166/367; 405/224.2; 405/224.3

(58) Field of Search ..... 166/355, 345, 166/346, 367; 405/158, 169, 224.2, 224.3, 224.4

(56) References Cited

U.S. PATENT DOCUMENTS 3,465,817 A * 9/1969 Vincent ..... 166/355
3,486,555 A * 12/1969 Vincent ..... 166/355
4,240,506 A * 12/1980 Dareing ..... 166/367
4,647,254 A * 3/1987 Baugh et al. ..... 166/345
4,808,034 A * 2/1989 Birch ..... 166/367
4,844,165 A * 7/1989 Van Der Steeg ..... 15/104.061
5,069,488 A * 12/1991 Freyer et al. ..... 166/355
5,722,802 A * 3/1998 March ..... 134/102.2
5,947,642 A * 9/1999 Teixeira et al. ..... 166/340
6,173,781 B1 * 1/2001 Milne et al. ..... 166/344
6,253,855 B1 * 7/2001 Johal et al. ..... 166/345
6,386,290 B1 * 5/2002 Headworth ..... 166/346

* cited by examiner

*Primary Examiner*—Thomas B. Will
*Assistant Examiner*—Thomas A. Beach
(74) *Attorney, Agent, or Firm*—Wenderoth, Lind & Ponack, L.L.P.

(57) ABSTRACT

A device in connection with a riser (1) for the transport of oil and/or gas, possibly including water, from a transport system, transport pipe (5) or similar structure on the sea bed to a platform or similar arrangement. To permit the use a riser (1) for the transport of oil and/or gas from a small field with low oil/gas production where a transport pipe (5) with a small diameter is used, a flexible pipe (4) with generally the same internal diameter as the transport pipe (5) is arranged inside the riser (1). At its upper and lower ends, the riser (1) is provided with a coupling (6, 7), which forms a seal between the transport pipe (5) and the flexible pipe (4) and also forms a seal at the ends of the riser so that the riser is closed.

10 Claims, 3 Drawing Sheets

ARRANGEMENT RELATED TO RISER PIPELINES

BACKGROUND OF THE INVENTION

The present invention concerns a device in connection with a riser for the transport of oil and/or gas, possibly including water, from a well head, transport pipe or similar structure on the sea bed to a platform.

Based on exploration activities in the North Sea in recent years, it seems today as if the era of large oil and gas finds is over. On the other hand, there have been many finds of a smaller size. At current oil/gas prices, they are not really commercially attractive/profitable, but in the future they may be interesting if oil prices increase and/or the technical solutions for extraction of oil become cheaper.

Many platforms which are already installed and in use have reserve risers for future developments. A common feature of these risers is that they were meant for large new fields. Their dimensions are therefore often much larger than what can be used for production from marginal fields with modest production and service life.

The situation is, therefore, that many risers which are held in reserve will never be used. In theory, it is conceivable for a transport pipe with a small diameter from a marginal production field to be connected directly to an existing reserve riser of a larger diameter. However, this is not possible as the authorities and the regulations require, among other things, that the riser and the production pipe can be reamed (pigged), which can be difficult or impossible to do at the transition from a large to a small pipe.

The alternative, therefore, is to lay a new riser which meets the statutory requirements for strength and installation. A new riser is, however, very expensive and may, as indicated above, contribute to reducing the incentive for developers to undertake the development of small oil and gas fields. In the worst case scenario, development may be stopped for lack of profitability.

SUMMARY OF THE INVENTION

The present invention represents a solution which makes it possible to use existing reserve risers with the pressure class and strength with which such risers were installed and which meet the requirements of the existing regulations. The solution makes it possible to perform pigging and is also less expensive to install and use compared with the installation of new risers.

In accordance with the present invention, the solution is characterised in that, in order to use a riser for the transport of oil from a small oil field with low oil/gas production where a transport pipe with a small diameter is used, a flexible pipe with generally the same internal diameter as the transport pipe is arranged inside the riser. At its upper and lower ends, the riser is provided with a coupling, which forms a seal between the transport pipe and the flexible pipe and also forms a seal at the ends of the riser so that it is closed.

BRIEF DESCRIPTION OF THE DRAWINGS

The present invention will be described in further detail in the following using examples and with reference to the attached drawings, in which.

DETAILED DESCRIPTION OF THE INVENTION

Figure 1:
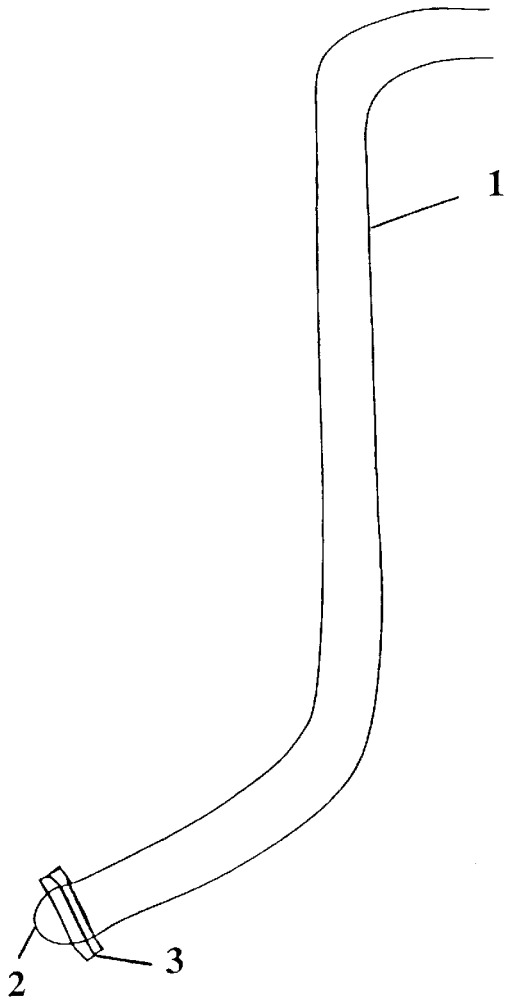
FIG. 1 is a schematic illustration of a riser.
Figure 2:
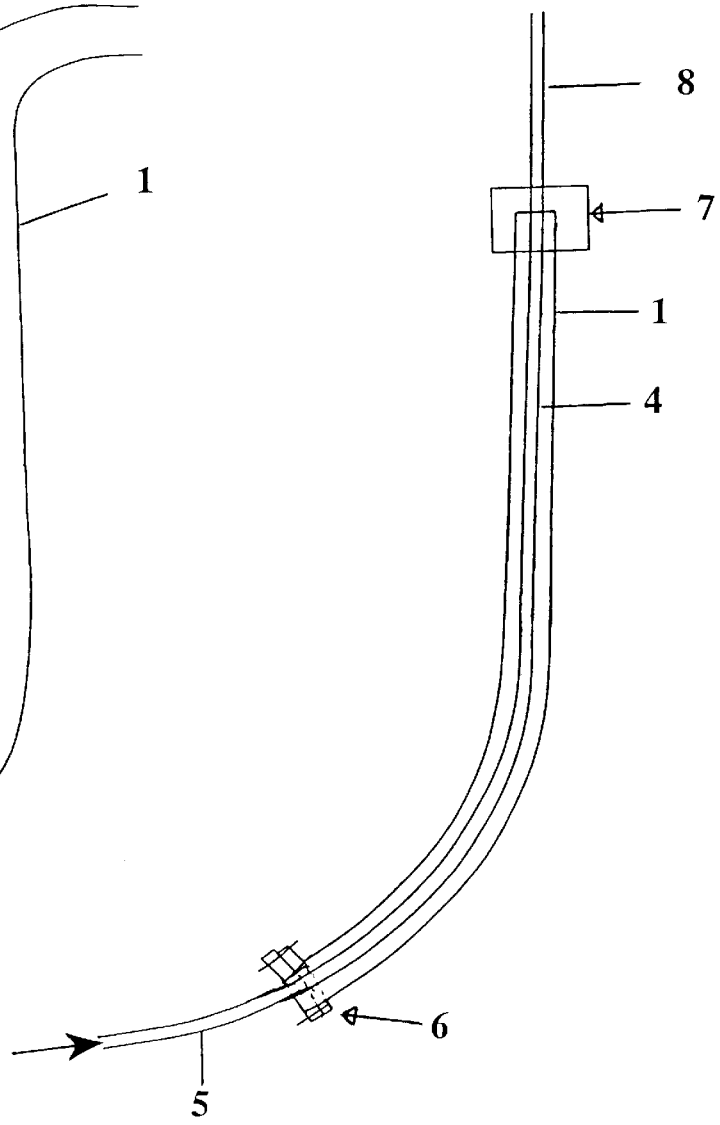
FIG. 2 is schematic illustration that is similar to FIG. 1 but is modified in accordance with the present invention.

As indicated above, FIG. 1 shows a simple sketch of a riser 1. When new platforms are installed at sea in connection with the development of new oil fields, the platforms (not shown) are provided with additional (reserve) risers 1 for use in connection with subsequent field developments in addition to risers which are intended for immediate use. Such additional risers 1 are often provided with a blinding in the form of a plug 2 or similar structure at the end of the riser, for example fixed via a flange connection 3.

The platforms are provided with the additional risers because it is not expensive to lay the pipes while the platform is being constructed but very expensive once the platform has been launched and positioned in the oil/gas field. The pipes are classified as risers and meet the given requirements for pressure, temperature and corrosion resistance.

For large new oil fields, the production or transport pipe on the sea bed will have a diameter equivalent to that of the necessary risers on the platform so that the transport pipe can be connected directly to the riser. For small fields, where transport pipes with a smaller diameter are used, such direct connection is often not possible, as stated above. However, the present invention represents a solution which makes it possible to use existing large, available pipes. The solution is based on inserting a flexible pipe 4, with generally the same internal diameter as the transport pipe 5 from a near or remote well head underwater production plant (not shown), inside the riser 1. The transport pipe 5 is connected to the flexible pipe 4 via a coupling 6 at the lower end of the riser. An equivalent coupling 7 can be used between the flexible pipe 4 and the process pipe system 8 on the platform.

The coupling 6, 7 also forms a seal at the ends of the riser so that it is closed. This represents an important feature of the present invention, as the internal, flexible pipe is expediently perforated or permeable in some other way so that the oil/gas penetrates out into and equalizes the pressure against the space (annulus) between the flexible pipe 4 and the riser 1. This results in the maintenance of a constant pressure, P1=P2 (see FIG. 5), between the annulus and the internal, flexible pipe 4. This, in turn, results in several advantages:

- The original reserve riser 1 is used to the full extent in relation to its classification with regard to pressure, temperature and material. Consequently, it is possible to use a much less expensive, non-classified, flexible internal pipe 4 formed of various material types and designs.
- Installation of the internal flexible pipe 4 is very simple and inexpensive compared with the installation of a new riser with the correct dimensions.

It is possible to perform pigging on the flexible pipe.

Overall, therefore, the present invention represents a much simpler and less expensive solution than having to install a new riser with a small diameter within the existing qualification requirements for an existing platform.

Figure 3:
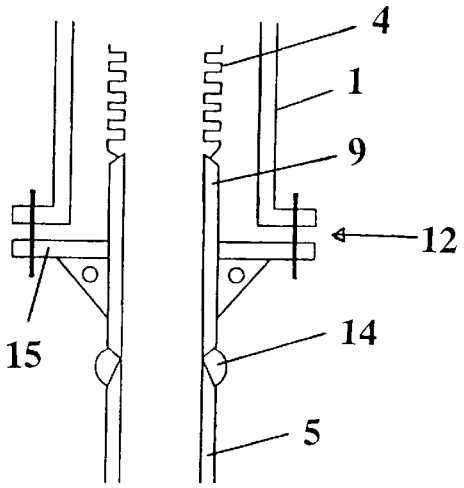
FIGS. 3–5 are enlargements of three different solutions for connecting a production pipe to an existing riser in accordance with the present invention.
Figure 4:
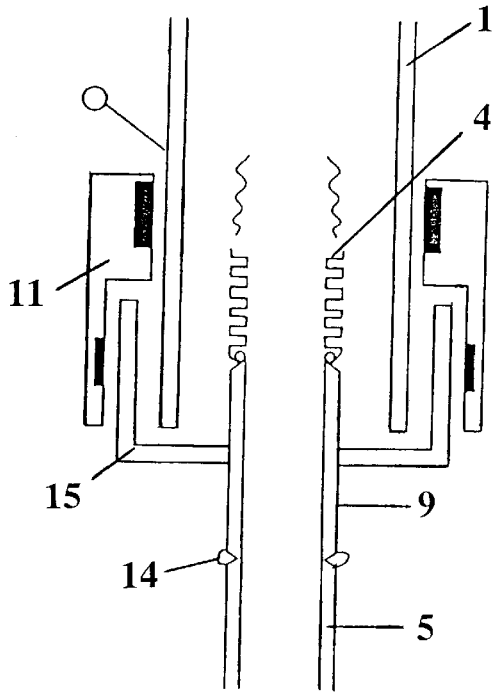
Figure 5:
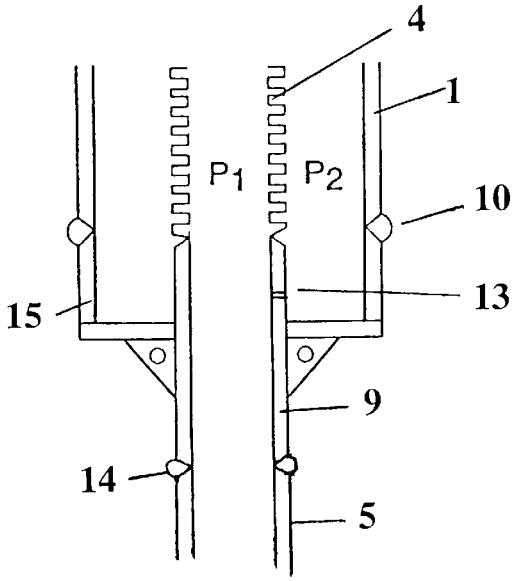
Figure 6:
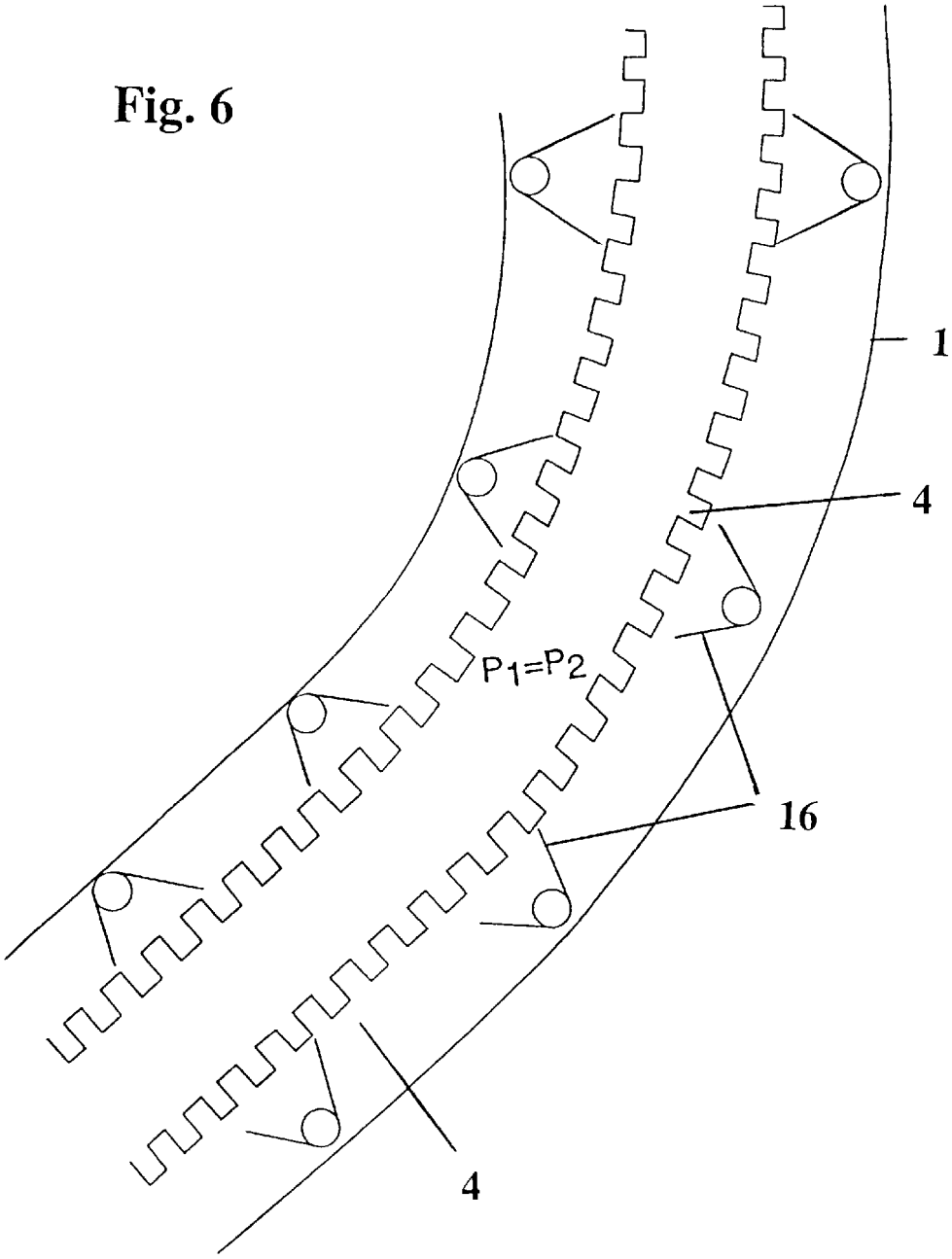
FIG. 6 is an enlargement of an alternative embodiment with distance rings between an internal flexible pipe and the existing riser.

FIGS. 3, 4 and 5 show alternative couplings between the transport pipe 5, riser 1 and flexible internal pipe 4. It is expedient to use an intermediate pipe coupling 9 between the transport pipe 5 and the flexible pipe 4. It can advantageously be connected to the respective pipes by welding. The pipe coupling 9 is fixed tightly in an end piece 15, which, in turn, may be connected to the riser 1 by means of a weld connection 10 as shown in FIG. 5, a sleeve clamp connection 11 as shown in FIG. 4 or a flange connection as shown in FIG. 3.

In connection with the installation of the flexible pipe 4 in the riser 1 and during regular production of oil/gas for the production system, water may accumulate in the annulus between these pipes. This may expediently be sucked into the flexible pipe via a venturi nozzle 13, as shown in FIG. 5, to reduce potential corrosion attack.

Moreover, regarding the installation of the flexible pipe 4, it is important that it is held in place inside the riser, particularly in connection with pigging the pipe.

This may expediently be done using distance rings 16 arranged at intervals.

With regard to the expression "flexible pipe" 4, as defined in the claims, this concerns not only pipes which can be bent without suffering plastic deformation, but also pipes which are divided into sections and which are articulated. The pipe must be able to be pushed or drawn through a riser and adapt to the bends or curves of the riser. Furthermore, the riser need not be a reserve riser, but may equally well be a riser which has previously been used for production from a large field with high production.

What is claimed is:

1. A riser assembly for the transport of fluids from a sea bed to a surface facility, said riser assembly comprising:

a riser for the transport of fluids from a small oil/gas field;

a flexible pipe arranged inside of said riser such that an annulus is formed between said riser and said flexible pipe, the annulus having an upper end and a lower end;

a first coupling device provided at an upper end of said riser, wherein said first coupling device forms a seal that doses the upper end of the annulus so as to prevent communication with the annulus through the upper end thereof; and a second coupling device provided at a lower end of said riser, wherein said second coupling device forms a seal that closes the lower end of the annulus.

2. The riser assembly as claimed in claim 1, wherein said flexible pipe is perforated along its entire length.

3. The riser assembly as claimed in claim 1, wherein said flexible pipe is permeable along its entire length.

4. The riser assembly as claimed in claim 1, further comprising a transport pipe connected to said flexible pipe via said second coupling device.

5. The riser assembly as claimed in claim 4, wherein said second coupling device comprises an intermediate pipe coupling connected to said flexible pipe and said transport pipe, wherein said intermediate pipe is arranged in an end sealing piece that is connected to the lower end of said riser.

6. The riser assembly as claimed in claim 5, wherein said end sealing piece comprises a plate that is welded to the lower end of said riser.

7. The riser assembly as claimed in claim 5, wherein said end sealing piece comprises a plate that is fixed to the lower end of said riser by a flange connection.

8. The riser assembly as claimed in claim 5, wherein said intermediate pipe coupling includes a venturi nozzle.

9. The riser assembly as claimed in claim 1, further comprising a plurality of distance rings disposed in the annulus to position said flexible pipe in said riser.

10. A riser assembly for the transport of fluids from a sea bed to a surface facility, said riser assembly comprising:

a riser for the transport of fluids;

a flexible pipe arranged inside of said riser such that an annulus is formed between said riser and said flexible pipe, the annulus having an upper end and a lower end;

a first coupling device provided at an upper end of said riser, wherein said first coupling device forms a seal that prevents communication with the annulus through the upper end thereof; and a second coupling device provided at a lower end of said riser, wherein said second coupling device forms a seal that prevents communication with the annulus through the lower end thereof.

* * * * *